US007703869B2

(12) United States Patent
Ota

(10) Patent No.: US 7,703,869 B2
(45) Date of Patent: Apr. 27, 2010

(54) IMAGE FORMING DEVICES

(75) Inventor: Yasuhira Ota, Yatomi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 267 days.

(21) Appl. No.: 12/049,446

(22) Filed: Mar. 17, 2008

(65) Prior Publication Data

US 2008/0238994 A1 Oct. 2, 2008

(30) Foreign Application Priority Data

Mar. 30, 2007 (JP) ..... 2007-090817

(51) Int. Cl.
*B41J 25/308* (2006.01)

(52) U.S. Cl. ..... 347/8; 400/58

(58) Field of Classification Search ..... 347/5, 347/8, 31; 400/25, 55, 58, 59
See application file for complete search history.

(56) References Cited

U.S. PATENT DOCUMENTS

| | | | | |
|---|---|---|---|---|
| 6,733,102 | B2 * | 5/2004 | Hosono | 347/14 |
| 6,869,235 | B2 * | 3/2005 | Kawaguchi et al. | 400/59 |
| 6,874,956 | B2 * | 4/2005 | Kelley et al. | 400/59 |
| 2004/0051755 | A1 | 3/2004 | Kanamitsu et al. | |
| 2006/0023052 | A1 | 2/2006 | Watanabe et al. | |
| 2006/0170749 | A1 | 8/2006 | Watanabe | |
| 2006/0268087 | A1 | 11/2006 | Sasa | |

FOREIGN PATENT DOCUMENTS

| | | | |
|---|---|---|---|
| JP | 2002192777 | A | 7/2002 |
| JP | 2003-039753 | A | 2/2003 |
| JP | 2004090463 | A | 3/2004 |
| JP | 2006035685 | A | 2/2006 |
| JP | 2006-205697 | A | 8/2006 |
| JP | 2006-224504 | A | 8/2006 |
| JP | 2006-326990 | A | 12/2006 |

OTHER PUBLICATIONS

Japan Patent Office; Notice of Reasons for Rejection in Japanese Patent Application No. 2007-090817 (counterpart to the above-captioned U.S. patent application) mailed Aug. 12, 2009.

* cited by examiner

*Primary Examiner*—Lamson D Nguyen
(74) *Attorney, Agent, or Firm*—Baker Botts, LLP.

(57) ABSTRACT

An image forming device includes a recording head including a nozzle face, in which the recording head is configured to dispense ink onto a recording medium to form an image thereon. The device also includes a supporting member which faces the nozzle face and is configured to support the recording medium, and an ink receiving portion which is positioned on the supporting member and faces the nozzle face. The ink receiving portion includes a first plurality guides, and a second plurality of guides. Each of the first plurality of guides and each of the second plurality of guides includes a guide face and is configured to guide the ink dispensed from the recording head. Moreover, the guide face includes a first portion and a second portion, and a first distance between the first portion and the nozzle face is less than a second distance between the second portion and the nozzle face. In addition, each of the first plurality of guides is configured to guide the ink dispensed from the recording head in a first ink flowing direction, and each of the second plurality of guides is configured to guide the ink dispensed from the recording head in a second ink flowing direction opposite the first ink flowing direction.

21 Claims, 14 Drawing Sheets

IMAGE FORMING DEVICES

CROSS-REFERENCE TO RELATED APPLICATION

The present application claims priority from Japanese Patent Application Publication No. JP-2007-090817, which was filed on Mar. 30, 2007, the disclosure of which is incorporated herein by reference in its entirety.

BACKGROUND OF THE INVENTION

1. Field of the Invention

The present application relates generally to an inkjet image forming device and more specifically, to an inkjet image forming device having a supporting portion, such as a platen, suitable for marginless image forming on a recording medium.

2. Description of Related Art

In a known inkjet type image forming device, a recording head is positioned to face a platen and ejects ink onto a recording medium conveyed on the platen in a sub-scanning direction while moving in a main scanning direction perpendicular to the sub-scanning direction. When the image forming device performs marginless image forming, the recording head ejects ink beyond edges of the recording medium, thereby forming an image which reaches the edges of the recording medium, such that there are no margins.

In such marginless image forming, ink that is ejected from the recording head beyond the edges of the recording medium onto the platen may adhere to the platen. When an edge, e.g., a lead edge or a trail edge, of the recording medium is bent over the platen and contacts the adhered ink, the back side of the recording medium may be stained with the ink.

Another known image forming device, such as the image forming device described in Japanese Laid-Open Patent Application No. 2006-35685, is configured to prevent a recording medium from being stained with ink adhered to a platen. In this known image forming device, the platen has upstream ribs and downstream ribs with respect to a recording medium conveying direction, and a marginless recording area is provided between the upstream ribs and the downstream ribs. First ribs, second ribs, and third ribs are formed in the marginless recording area at suitable intervals in a direction perpendicular to the recording medium conveying direction so as to support the lead and trail edges of the recording medium. Grooves are formed between the first, second, and third ribs to extend in the recording medium conveying direction and to communicate with an ink absorber positioned on a bottom plate of the platen.

In this known image forming device, if a distance between a nozzle face and an ink receiving surface defined by the grooves is too great, ink discharged into the grooves may transform into an ink mist and may float above the platen. Ink mist may be generated from the ink that has not yet reached the ink receiving surface after being ejected from the recording head, or may be generated from the ink accumulated on the ink receiving surface. Such ink mist may adhere to and stain the back side of the recording medium.

On the other hand, if the distance between the nozzle face and the ink receiving surface defined by the grooves is reduced to prevent the generation of such ink mist, a lead edge and a trail edge of the recording medium may contact the ink receiving surface. If the ink is accumulated on the ink receiving surface without being drained quickly therefrom, the ink may adhere to and stain the recording medium.

SUMMARY OF THE INVENTION

Therefore, a need has arisen for image forming devices which overcome these and other shortcomings of the related art. A technical advantage of the present invention is that ink is relatively quickly drained from an ink receiving surface of a platen, and generation of ink mist is suppressed, thereby preventing or substantially preventing a recording medium from being stained with ink or ink mist.

According to an embodiment of the present invention, an image forming device comprises a recording head comprising a nozzle face, in which the recording head is configured to dispense ink onto a recording medium to form an image thereon. The device also comprises a supporting member which faces the nozzle face and is configured to support the recording medium, and an ink receiving portion which is positioned on the supporting member and faces the nozzle face. The ink receiving portion comprises a first plurality guides, and a second plurality of guides. Each of the first plurality of guides and each of the second plurality of guides comprises a guide face and is configured to guide the ink dispensed from the recording head. Moreover, the guide face comprises a first portion and a second portion, and a first distance between the first portion and the nozzle face is less than a second distance between the second portion and the nozzle face. In addition, each of the first plurality of guides is configured to guide the ink dispensed from the recording head in a first ink flowing direction, and each of the second plurality of guides is configured to guide the ink dispensed from the recording head in a second ink flowing direction opposite the first ink flowing direction.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-13B, like numerals being used for like corresponding parts in the various drawings.

Figure 1:
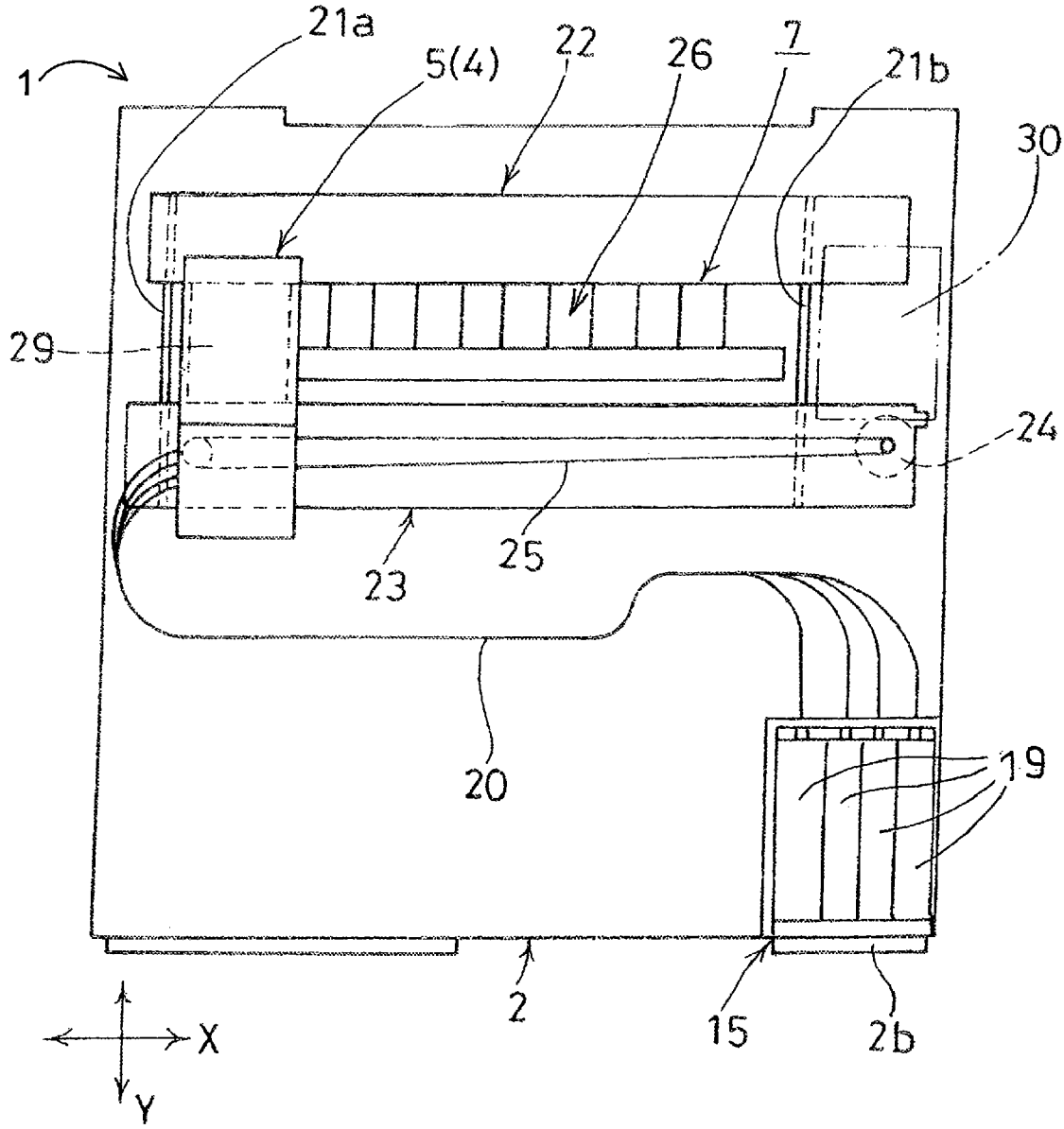
FIG. 1 is a plan view of an image forming device with an image reading device removed, according to an embodiment of the present invention.

An image forming device, such as a multi-function device 1, may be configured to perform a plurality of functions, such as printing, copying, scanning, and facsimile functions. As shown in FIG. 1, a sheet cassette 3 may be positioned at a lower portion of a housing 2 of a recording device, and may be removable from the housing 2 via an insertion opening which is open at a front side (lower side in FIG. 1) of the housing 2 (lower side in FIG. 1). The housing 2 may comprise a synthetic resin. Hereinafter, the side provided with the opening is referred to as the front, and other sides are referred to as the right, left, and rear with reference to the front.

The sheet cassette 3 may be configured to store a recording medium P, such as an A4 size recording medium, a letter size recording medium, a legal size recording medium, a postcard size recording medium, or the like, may be stored in the sheet cassette 3 with their shorter sides perpendicular to a sheet conveying direction, e.g., a Y-axis direction. An auxiliary sheet cassette 3*a* for a relatively small sized recording medium may be mounted on the sheet cassette 3.

An inclined separation plate 8 may be configured to separate and to convey a recording medium from the rest of the recording medium, and may be positioned at a rear of the sheet cassette 3. An arm 6*a* may be attached to the housing 2, and may be vertically pivotable about its upper end. A sheet feed roller 6 may be positioned at a lower end of the arm 6*a* and operate in cooperation with the inclined separation plate 8 to sequentially separate and feed the recording medium P stacked in the sheet cassette 3 or the auxiliary sheet cassette 3*a*. The separated recording medium P may be fed via a sheet conveying path 9, e.g., a U-shaped conveying path, to a recording unit 7 located above the sheet cassette 3. The recording unit 7 may comprise a carriage 5 which is configured to reciprocate in a main scanning direction, e.g., an X-axis direction, and an inkjet type recording head 4 may be positioned on, e.g. mounted to, the carriage 5, such that the recording head 4 is configured to move with the carriage 5.

A discharge portion 10 may be formed above the auxiliary sheet cassette 3*a*. The recording medium P on which an image has been recorded by the recording unit 7 may be discharged into the discharge portion 10 with its recording surface facing in an upward direction. A discharge opening continuing to the discharge portion 10 may be open frontward of the housing 2.

An image reading device, such as a scanning unit (not shown), may be positioned at an upper portion of the housing 2. The image reading device may be configured to read an image from a document, and the multi-function device 1 may be configured to copy the image or transmit a facsimile comprising the image, or both.

The multi-function device 1 also may comprise an operation panel (not shown) comprising a plurality of operation buttons and a liquid crystal display (LCD). The operation panel may be positioned at the front of the scanning unit at the upper portion of the housing 2.

A cartridge storing unit 15 may be formed in the front of the housing 2 at one side of the discharge portion 10. A front of the cartridge storing unit 15 may be covered by a cover 2*b*. The cartridge storing unit 15 may be configured to store ink cartridges which comprise different color inks, e.g., each ink cartridge may store a different color ink corresponding to black ink, cyan ink, magenta ink, and yellow in, respectively. Each of the ink cartridges may be shaped like a box having a relatively small area in the plan view and having a relatively large height. The ink cartridges may be aligned in a row along the X-axis direction and removable from the front of the housing 2.

The ink may be supplied from the ink cartridges 19 to the recording head 14 via a plurality of ink tubes 20, e.g., four ink tubes. When five or more color inks, e.g., six to eight ink colors are used, the cartridge storing unit 15 may be configured to store ink cartridges corresponding to the number of color inks, and the number of the ink tubes 20 may be increased, accordingly.

A first guide member 22 and a second guide member 23 may comprise plate members extending in the X-axis direction, and may be supported by a right side wall 21*a* and a left side wall 21*b*, respectively, of a main frame 21. The carriage 5 may be positioned on the first guide member 21*a* and the second guide member 21*b*, and may be configured to slide thereon. A timing belt 25, e.g., an endless timing belt, and a carriage motor 24, e.g., a DC motor, a stepping motor, or the like, for driving the timing belt 25 may be configured to reciprocate the carriage 5. The timing belt 25 may be wounded around a plurality of pulleys to stretch over and along an upper surface of the second guide member 23.

A platen 26 may be positioned below the recording head 4 to support the conveyed recording medium P. A tape scale may extend along the X-axis direction of the carriage 5, and the tape scale may be a portion of an optical linear encoder for detecting the position and the moving speed of the carriage 5 in the X-axis direction. Driving signals may be inputted to the recording head 4 on the carriage 5 via a flexible flat cable.

Figure 2:
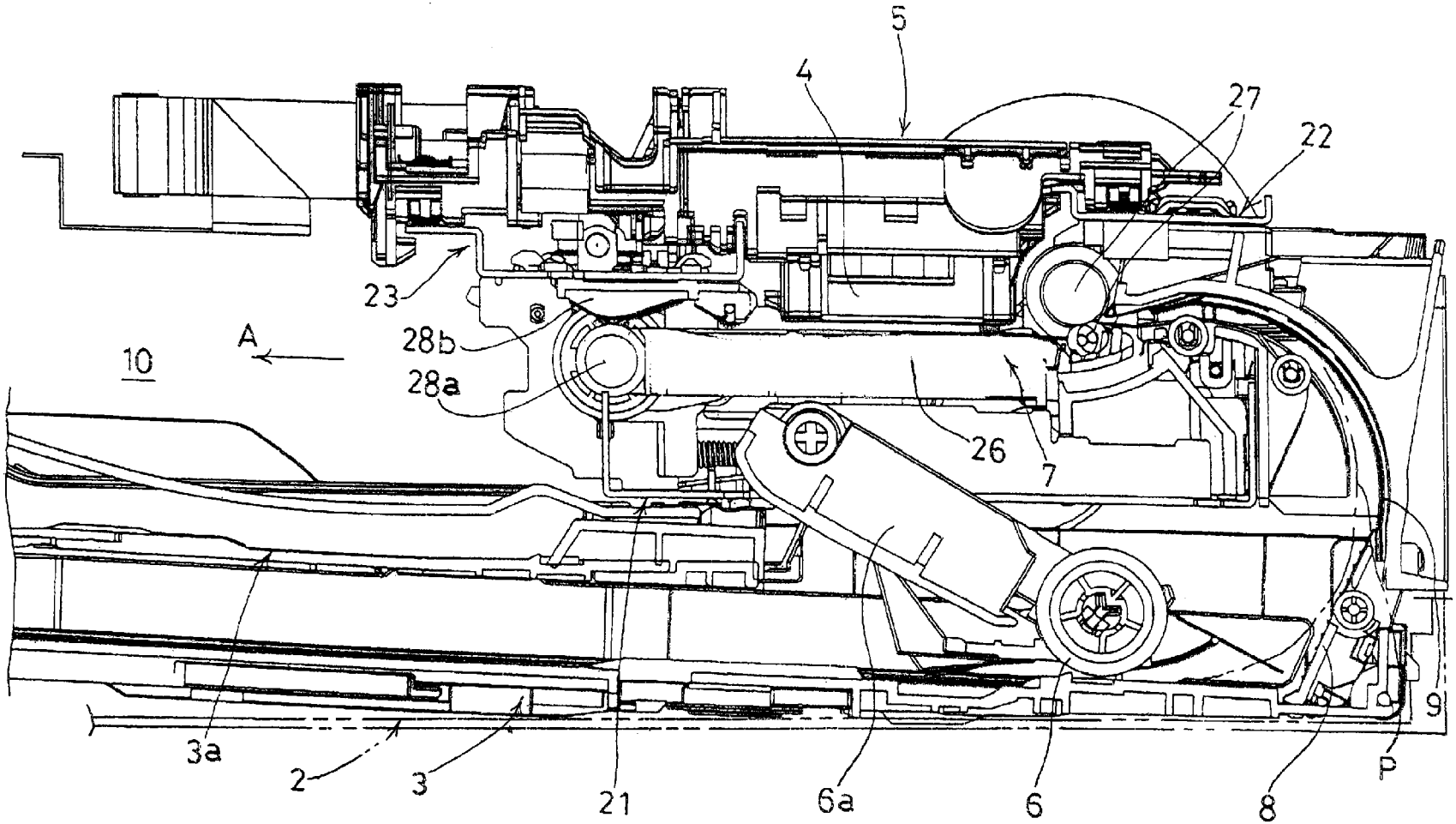
FIG. 2 is a side, sectional view of a recording unit and a sheet feed cassette of the image forming device, according to an embodiment of the present invention.

A pair of registration rollers 27 may be positioned upstream of the platen 26 in the sheet conveying direction, as shown by as arrow A in FIG. 2, to convey the recording medium P into a gap between a nozzle face 4*a* of the recording head 4 and the platen 26. Spur rollers 28*b* and a discharge roller 28*a* may be positioned downstream of the platen 26. The discharge roller 28*a* may convey the recording medium P onto which an image has been recorded to the discharge portion 10 while the spur rollers 28*b* contact the upper surface of the recording medium P.

An ink spittoon 29 may be positioned on one outer side of the width of the conveyed recording medium P adjacent to left side wall 21*a*. A maintenance unit 30 may be positioned on the other outer side of the width of the conveyed recording medium P adjacent to right side wall 21*b*. Ink is discharged periodically from the recording head 4 during recording operations at a flashing position in the ink spittoon 29 to prevent the nozzles from becoming clogged by ink. The ink spittoon 29 receives the discharged ink.

The maintenance unit 30 may restore the recording head 4, located at a standby position, to a normal state by selectively drawing inks of different colors, or by eliminating bubbles trapped in buffer tanks (not shown) above the recording head 4. In addition, the maintenance unit 30 may comprise a wiper (not shown) which is configured to clean the nozzle face of the recording head 4 when the carriage 5 moves from a position facing the maintenance unit 30 to an image recording area.

Figure 3:
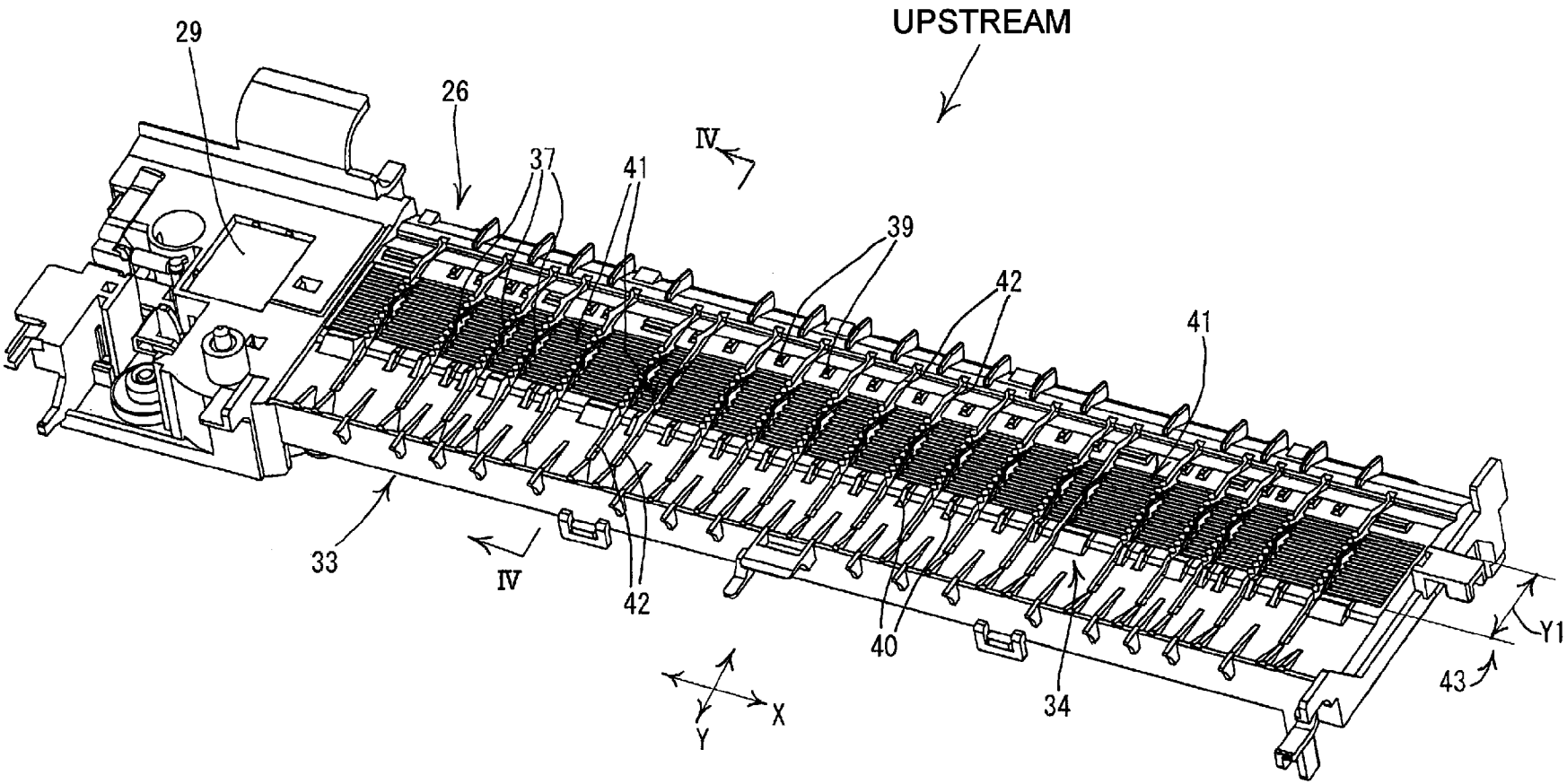
FIG. 3 is a perspective view of a platen, according to an embodiment of the present invention.
Figure 4:
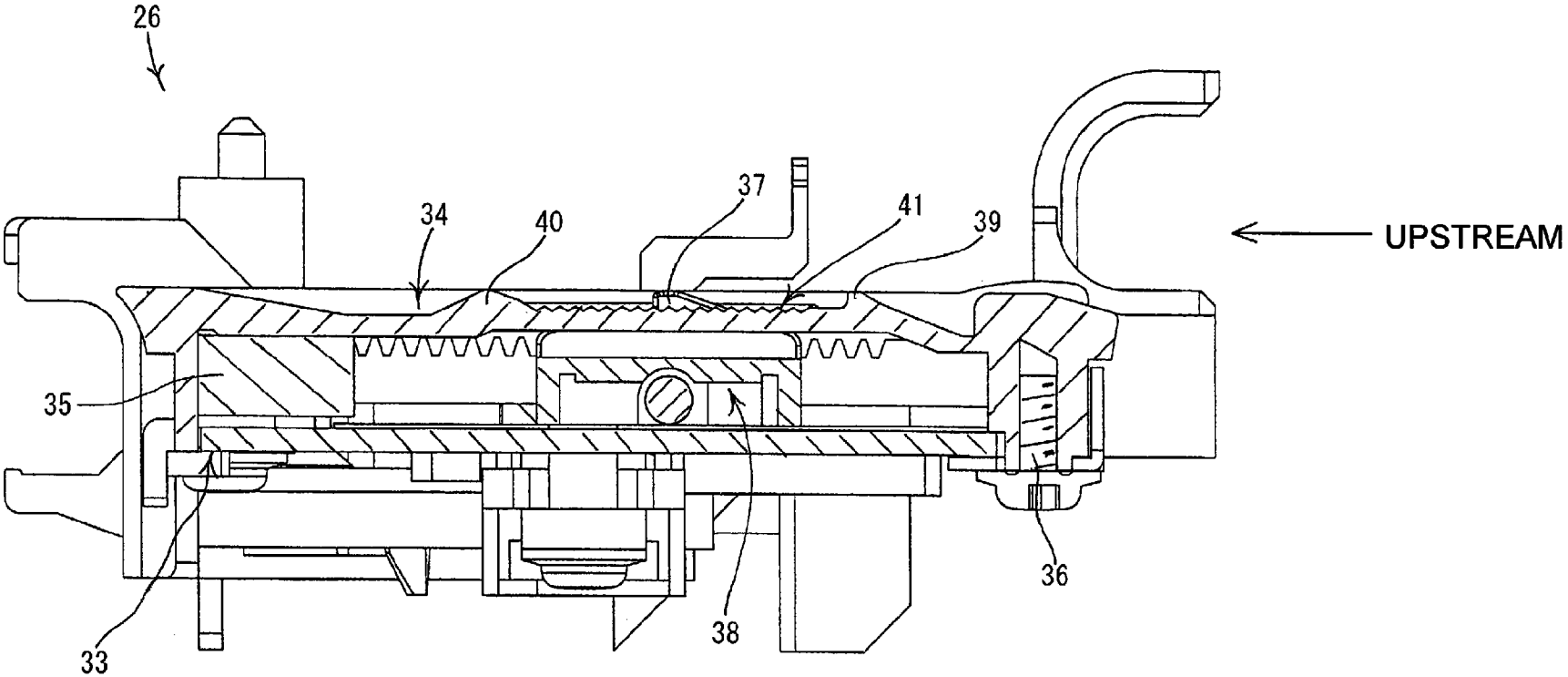
FIG. 4 is an enlarged, sectional view of the platen of FIG. 3, as viewed along line IV-IV.

Referring to FIGS. 3 and 4, the platen 26 may comprise a main body 33 having a flat plate shape, and a cover member 34 that is open downward and detachably covers an upper surface of the main body 34. A mounting screw 36 is screwed from a lower surface of the main body 33 into the cover member 34. An ink absorber 35 may be positioned in a downstream portion in the sheet conveying direction of a space defined by the main body 33 and the cover member 34. The ink absorber 35 may be elongated in the X-axis direction. A drive mechanism 38 for reciprocating movable ribs 37 in the sheet conveying direction may be stored in an upstream portion of the space. The ink absorber 35 may comprise a sheet member comprising fibers having high capillarity and diffusivity for the ink, and may function as a waste ink collector.

First support ribs 39 and second support ribs 40 may be integral with an upper surface of the cover 34 at predetermined intervals in the X-axis direction. The first support ribs 39 and the second support ribs 40 may be positioned in an upstream portion and a downstream portion, respectively, in the sheet conveying direction. Ink receiving portions 41 may be positioned between the first support ribs 39 and the second support ribs 40. Slits 42 may be formed in the cover member 34 at predetermined intervals in the X-axis direction, and may extend between the first support ribs 39 and the second support ribs 40. The movable ribs 37 are configured to reciprocate along the slits 42 in the Y-axis direction. The ink receiving portions 41 may be arranged in the X-axis direction, and each ink receiving portion 41 may be interposed between two slits. A support member for supporting the recording medium at least may comprise the cover member 34.

The first support ribs 39 may have substantially the same height as the second support ribs 40. The movable ribs 37 support a lead edge of the recording medium P having passed over the first support ribs 39. The movable ribs 37 move toward the downstream direction by substantially the same distance as a feed distance of the recording medium P in the Y-axis direction, such that the second support ribs 40 receive the lead edge of the recording medium P. Then, the movable ribs move in a reverse direction toward the upstream direction. Subsequently, the movable ribs move in the downstream direction while supporting a trail edge of the recording medium P having passed over the first support ribs 39, such that the second support ribs 40 receive the trail edge of the recording medium 40. With this structure, the lead and trail edges of the recording medium P are prevented from contacting the ink receiving portion 41.

Ink receiving portion 41 according to an embodiment of the present invention now will be described. A plurality of guide portions 44 and 45, e.g., first guide portions 44 and second guide portions 45, may be positioned in an image forming area or ink ejecting area 43, shown by Y1 in FIG. 3, of the ink receiving portion 41. The image forming area 43 faces the nozzle face 4*a* (FIG. 8B). Ink ejected downward from nozzles (not shown) in the nozzle face 4*a* and reaching the ink receiving portion 41 may be guided toward the slits 42.

Figure 8A:
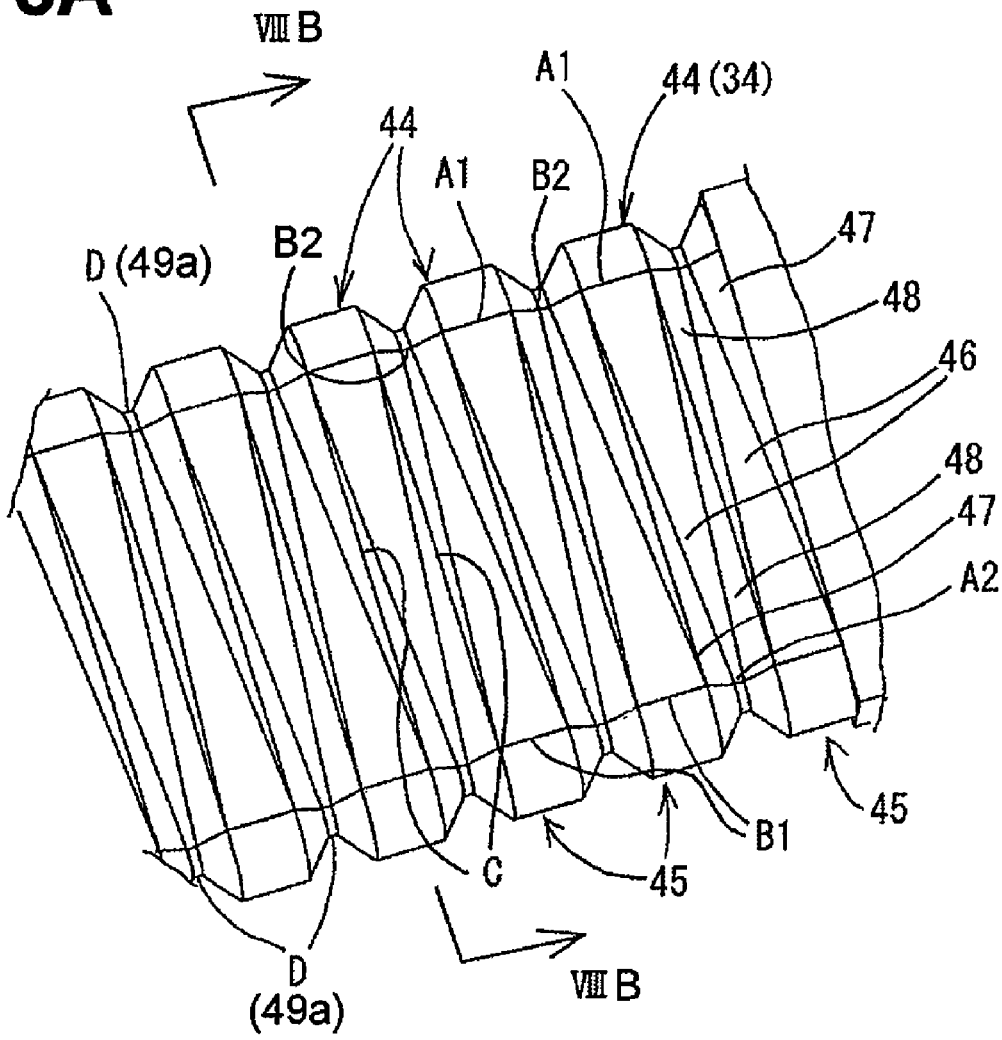
FIG. 8A is a perspective view of first guides and second guides of the ink receiving portion of FIG. 5, according to an embodiment of the present invention.
Figure 8B:
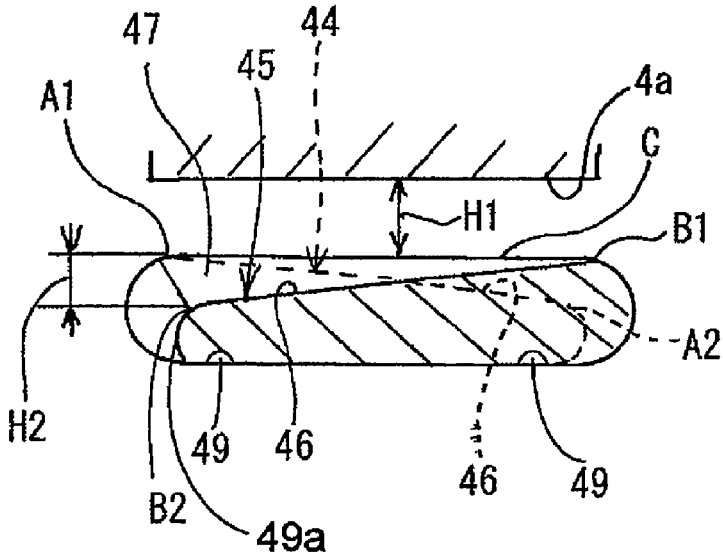
FIG. 8B is a sectional view of the ink receiving portion of FIG. 8A, as viewed along line VIIIB-VIIIB.

As shown in FIGS. 8A and 8B, each of the first guides 44 and each of the second guides 45 of the ink receiving portion 41 has a high portion A1 (B1) and a low portion A2 (B2). The high portion A1 (B1) may be separated from the nozzle face 4*a* by a distance H1, and the low portion A2 (B2) may be separated from the nozzle face 4*a* by a distance H1+H2. The first guide 44 may have a watershoot shape, and may comprise a slanting bottom face 46 and two opposed triangular side faces 47 and 48 extending slantingly from the bottom face 46 toward the nozzle face 4*a*. The bottom face 46 may comprise the high portion A1 and the low portion A2, and may be slanted, e.g., at a substantially constant rate (slope), such that the distance from the nozzle face 4*a* to the bottom face 46, or the depth of the first guide 44, gradually increases from the high portion A1 toward the low portion A2. Similarly, the second guide 45 may have a watershoot shape, and may comprise a slanting bottom face 46 and two opposed triangular slanting side faces 47 and 48 extending from the bottom face 46. The bottom face 46 may comprise the high portion B1 and the low portion B2, and may be slanted, such that the depth of the second guide 45 increases gradually from the high portion B1 toward the low portion B2. The bottom face 46 may function as a guide face for guiding the ink to the low portion A2 (B2), and the side faces 47 and 48 may function as partition faces for partitioning the first guide 44 from the second guide 45.

A borderline between the first guide 44 and the second guide 45 is a ridge line that connects the high portion A1 and the high portion B1, and has a constant height.

Figure 5:
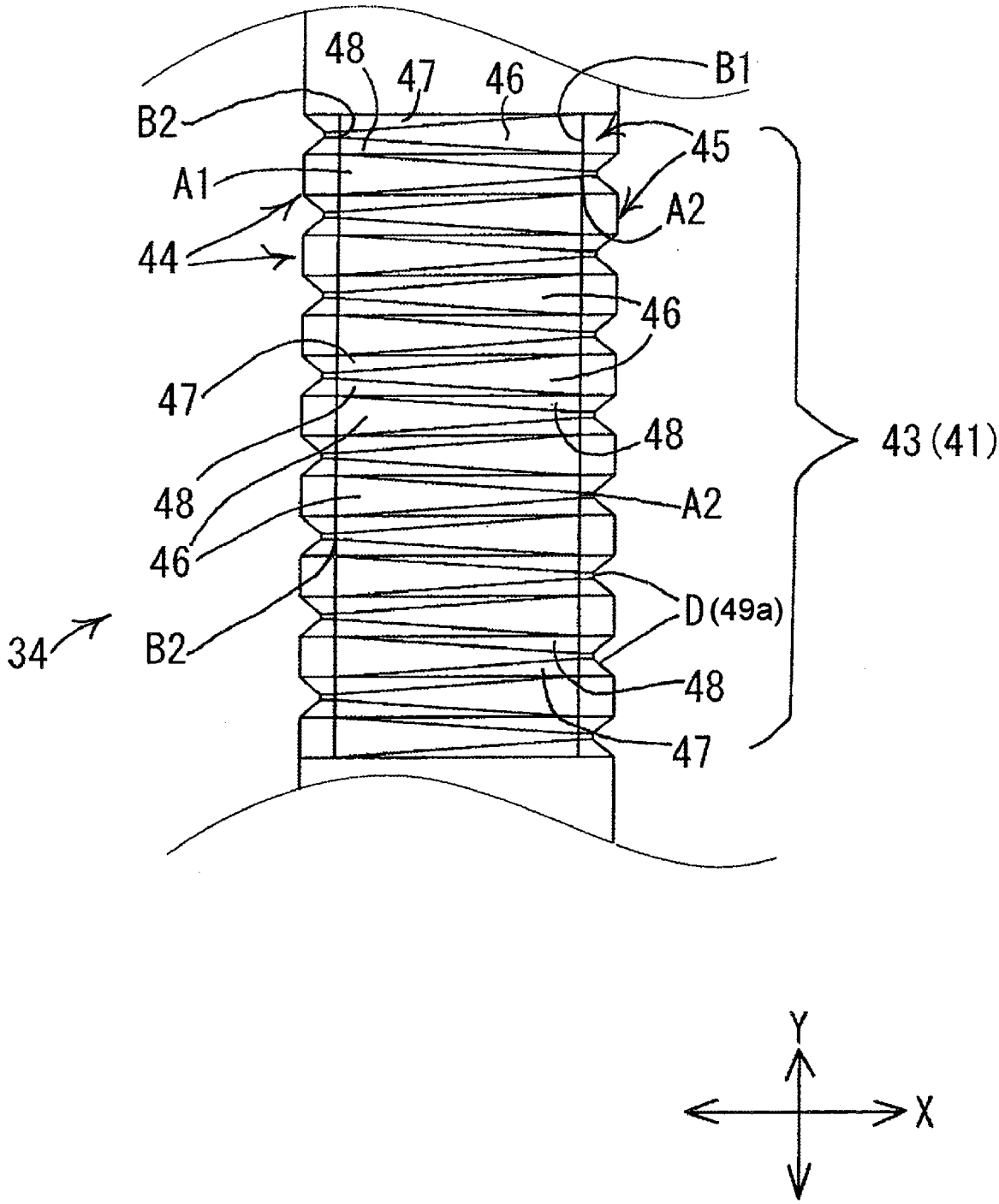
FIG. 5 is a partial, plan view of an ink receiving portion, according to an embodiment of the present invention.

As shown in FIGS. 5 and 8A, the bottom face 46 of the first guide 44 has a width that decreases gradually from the high portion A1 toward the low portion A2. The width of the bottom face 46 may be perpendicular to the ink flowing direction which is along the X-axis direction. Similarly, the bottom face 46 of the second guide 45 has a width that decreases gradually from the high portion B1 toward the low portion B2.

The first guide 44 and the second guide 45 may have the identical size and shape, and the number of first guides 44 may be equal to the number of second guides 45 in the ink receiving portion 41.

Ink reaching the first guide 44 and the second guide 45 of the ink receiving portion 41 flows from high to low by gravity. The ink flowing directions in the first and second guides 44 and 45 are opposite to each other. The ink flows from the high portion A1 toward the low portion A2 in the first guide 44, while the ink flows form the high portion B1 toward the low portion B2 in the second guide 45. The first guides 44 and the second guides 45 may be arranged alternatively, such that each first guide 44 may be sandwiched between two second guides 45. The ink flows in the first guides 44 and the second guides 45 along the X-axis direction, which is perpendicular to the sheet conveying direction.

One end portion of the bottom face 46 adjacent to the high portion A1 (high portion B1) and the other end portion of the bottom face 46 adjacent to the low portion A2 (low portion B2) may have a substantially trapezoidal shape in a plan view, and may have a semicircular shape in a sectional view (in a direction separated from the nozzle face 4*a*), as shown in FIG. 8B.

The distance (H1+H2) from the nozzle face 4*a* to the low portion A2 may be selected, such that the ink ejected from the nozzles in the nozzle face 4*a* may not transform into mist before reaching the bottom face 46. The distance (H1+H2) from the nozzle face 4*a* to the low portion B2 of the second guide 45 similarly may be selected.

The width of the low portion A2 (low portion B2) may be less than that of the high portion A1 (high portion B1). The width, which is perpendicular to the ink flowing direction, of the bottom face 46 decreases gradually from the high portion A1 (high portion B1) toward the low portion A2 (low portion B2). Thus, the capillarity for the ink and the ability to drain the ink increases gradually in such direction. Ink reaching the first guide 44 (second guide 45) may be guided from the high portion A1 (high portion B1) toward the low portion A2 (low portion B2).

In addition, the depth of the first guide 44 (second guide 45) increases gradually from the high portion A1 (high portion B1) toward the low portion A2 (low portion B2). Thus, ink accumulated in the first guide 44 and the second guide 45 flows smoothly. This enhances the drain of the ink from the surface of the platen 26.

The ability of the platen 26 to drain the ink may be enhanced by the combination of the height difference between the high portion A1 (high portion B1) and the low portion A2 (low portion B2) and the above-described capillarity for the ink. Accordingly, the ink is unlikely to overflow the platen 26, and the recording medium that passes over the platen 26 is unlikely to be stained with the ink.

The high portion A1 of the first guide 44 and the high portion B1 of the second guide 45 may be separated from the nozzle face 4*a* by a shorter distance and have a greater width, which is perpendicular to the ink flowing direction, as compared with the low portion A2 of the first guide 44 and the low portion B2 of the second guide 45, respectively. This improves the likelihood that ejected ink reaches the first and second guides 44 and 45, and reduces generation of ink mist. Thus, ink mist is unlikely to adhere to the cover 34, and the recording medium P is unlikely to be stained with the ink mist.

By the alternative arrangement of each first guide 44 and each second guide 45, each high portion A1 (high portions B1), which has a greater width and a shorter distance to the nozzle face 4*a*, and each low portion A2 (low portion B2), which has a shorter width and a greater distance to the nozzle face 4*a*, are alternatively arranged. In this case, the distribution of the high portions A1 and B1 and the low portions A2 and B2 may be uniform over the ink receiving portion 41. The distances from the nozzle face 41 to different positions of the ink receiving portion 41 are averaged over the ink-receiving portion 41 to a distance that will not cause generation of ink mist. Thus, when ink is ejected beyond edges of the sheet during marginless printing, the likelihood that ink ejected from the nozzles reaches the ink receiving portion 41 increases, and generation of ink mist is reduced.

In addition to the alternate arrangement of each first guides 44 and each second guide 45, if the first guide 44 and the second guide 45 have the identical size and shape, and the number of first guides 44 are equal to the number of second guides 45 in the ink receiving portion 41, the above-described effects may be enhanced.

The width of the bottom face 46 decreases from the high portions A1 (high portion B1) to the low portion A2 (low portion B2), and the bottom face 46 is slanted from the high portions A1 (high portion B1) to the low portion A2 (low portion B2). This allows the first ink guide 44 and the second ink guide 45 to have the ability to drain the ink greater than or equal to the ability to drain the ink of an ink guide having a flat bottom face and a depth which causes generation of ink mist.

Each first guide 44 and each second guide 45 are alternatively arranged, and the ink flowing directions are opposite to each other in the first guide 44 and the second guide 45. In this embodiment, the ink flowing directions in the first guide 44 and the second guide 45 are parallel to the X-axis direction. The average depth of the grooves defined by the first guide 44 and the second guide 45 is the same as when the first guide 44 and the second guide 45 are sectioned at any position in the X-axis direction along the line parallel to the Y-axis direction. Thus, even when the ink is ejected beyond the side edges (edges in the X-axis direction) of the recording medium P, generation of ink mist is reduced, and the ability to drain the ink is maintained.

Figure 6:
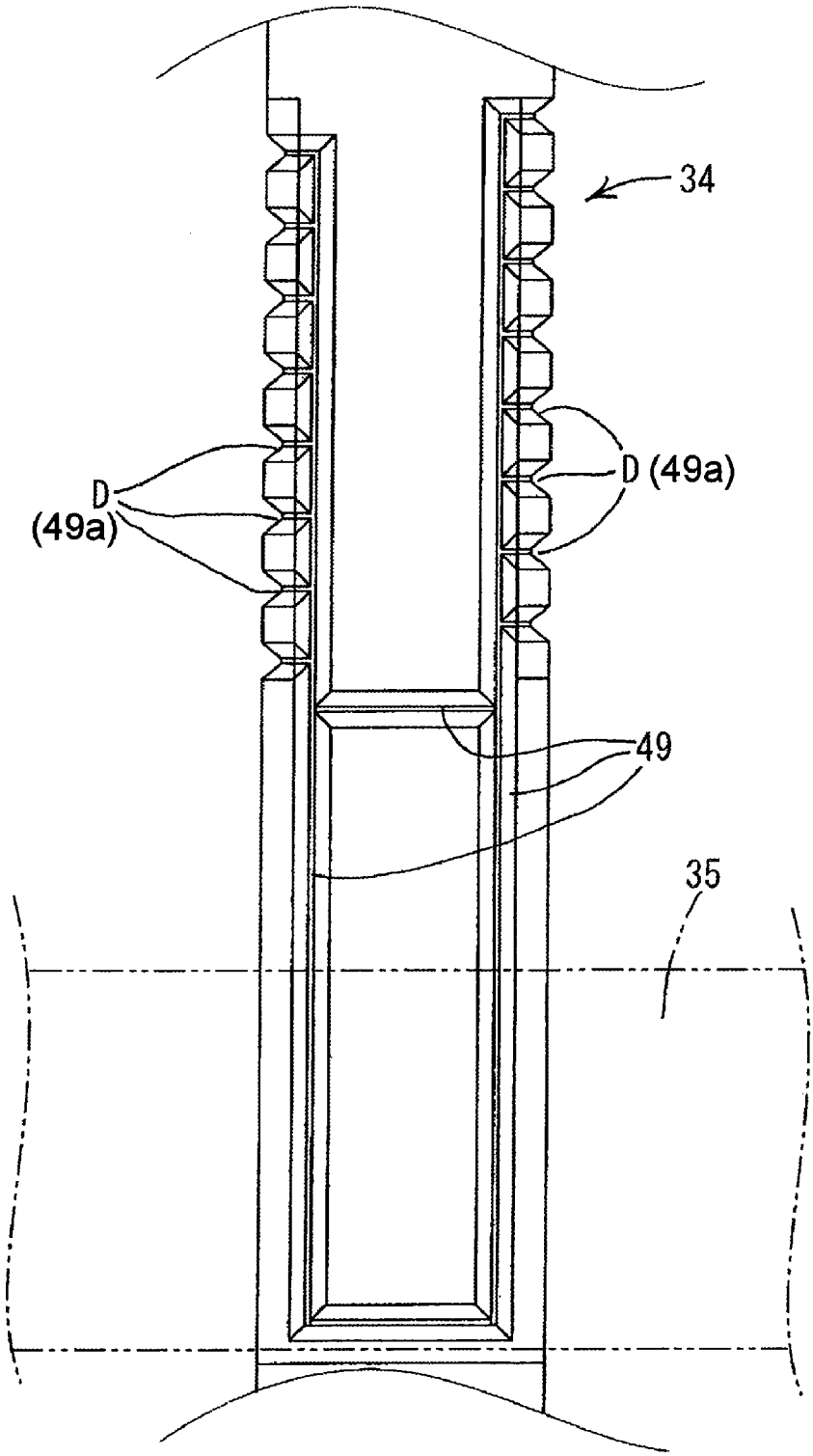
FIG. 6 is a partial, bottom view of the ink receiving portion of FIG. 5.
Figure 7:
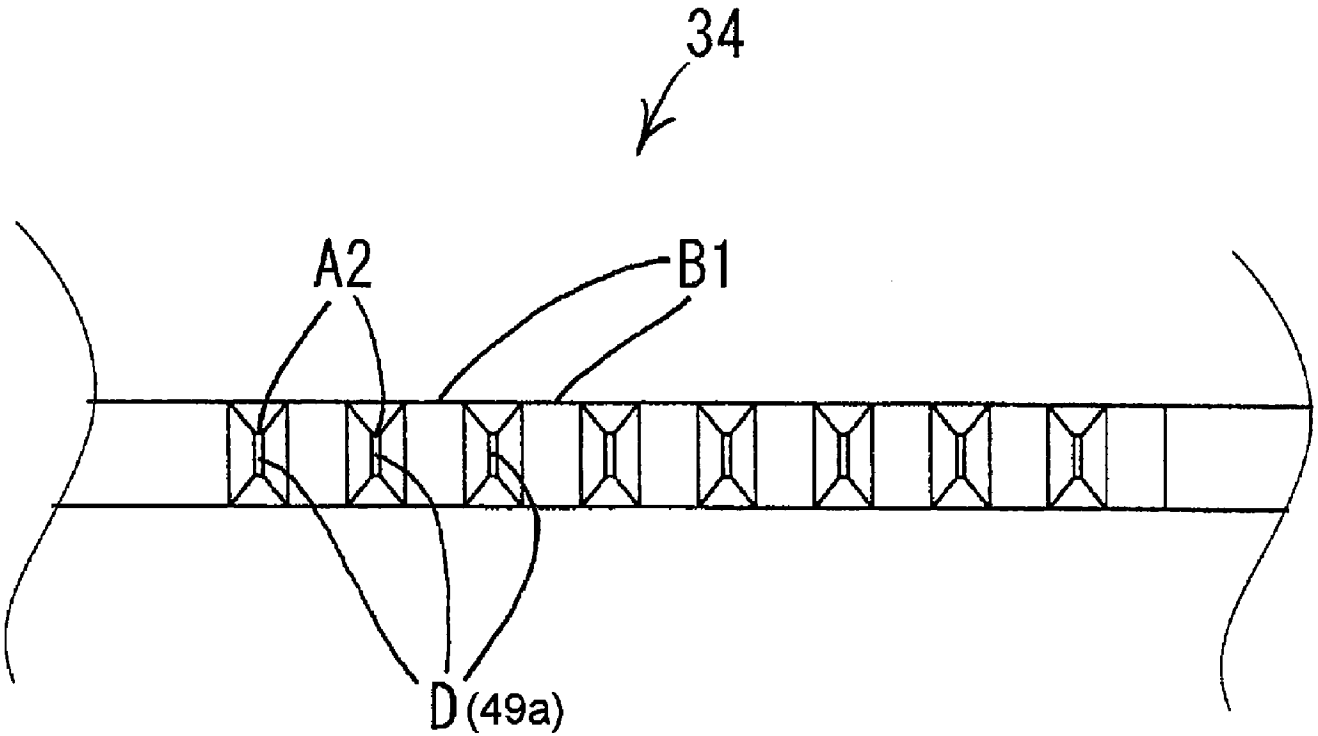
FIG. 7 is a partial, side view of the ink receiving portion of FIG. 5.

As shown in FIG. 6, drain grooves 49 may be formed in a lower surface (back surface) of the cover 34 to guide the ink from the low portions A2 (low portions B2) to an upper surface of the ink absorber 35, which may contact the lower surface of the cover 34. The ink absorber functions as a waste ink collector. More specifically, the low portions A2 of the first guides 44 and the low portions B2 of the second guides 45 communicate with the drain grooves 49, which extend along the lower surface of the cover 34. The drain grooves 49 comprise through grooves 49*a* that connect the upper surface and the lower surface of the cover 34. Each through groove 49*a* may be formed at an end portion D of the first guide 44 (second guide 45) adjacent to the low portion A2 (low portion B2). The ink flows downward in the through grooves 49*a* to the drain grooves 49. The through grooves 49*a* and the drain grooves 49 form drain passages. Although, in this embodiment, the drain grooves 49 are formed in the lower surface (back surface) of the cover 34, they may be formed in the upper surface (front surface) of the cover 34.

The through groove 49*a* may be defined by a bottom face and two opposed semicircular side faces of the end portion D, which are continuously formed from the bottom face 46 and the side faces 47 and 48, respectively. In this embodiment, the bottom width of the through groove 49*a* (the width of the bottom face of the end portion D) is less than or equal to the width of the low portion A2 (low portion B2), and the depth of the through groove 49*a* is less than or equal to the depth of the first guide 44 (second guide 45) at the low portion A2 (low portion B2), which is the distance between the high portion A1 (high portion B1) and the low portion A2 (low portion B2) in a direction perpendicular to the nozzle face 4*a* or the distance H2. Thus, the capillarity for the ink is maintained or increases from the low portion A2 (low portion B2) to the through groove 49*a*.

The drain grooves 49 may be V-shaped, semicircular shaped, or rectangular shaped in a sectional view. As described above, the ink absorber 35 may contact the lower surface of the cover 34. The ink absorber 35 positioned directly to the cover 34 allows the drain grooves 49 to be shorter than the case in which the ink absorber is positioned at the bottom or the like of the housing 2. The ink is prevented from being dried in the drain grooves 49, thereby not causing any ink flow stagnation by the ink dried in the drain grooves 49. Accordingly, the ink accumulated in the first guides 44 and the second guides 45 is drained smoothly to the ink absorber 35, and is unlikely to overflow the platen 26. As a result, the recording medium P that passes over the platen 26 is unlikely to be stained with the ink.

The ink absorber 35 may comprise a sheet member comprising fibers having high capillarity and diffusivity for the ink. The sheet member has a greater absorbing capacity (capillarity) than an absorbing member comprising a porous material, e.g., foamed polyurethane. The ink accumulated in the drain grooves 49 is efficiently absorbed (drawn) by the ink absorber 35. Consequently, the ink accumulated in the through grooves 49*a*, the first guides 44, and the second guides 45 may be guided toward the ink absorber 35 smoothly, without causing ink flow stagnation.

Because the drain grooves 49 are relatively short because of the ink absorber 35 positioned directly to the lower surface of the cover 34, as described above, the capillarity of the ink absorber 35 acts more greatly on the ink accumulated in the first guides 44, the second guides 45, the through grooves, and the drain grooves 49. The accumulated ink is drained efficiently to the ink absorber 35.

Figure 9:
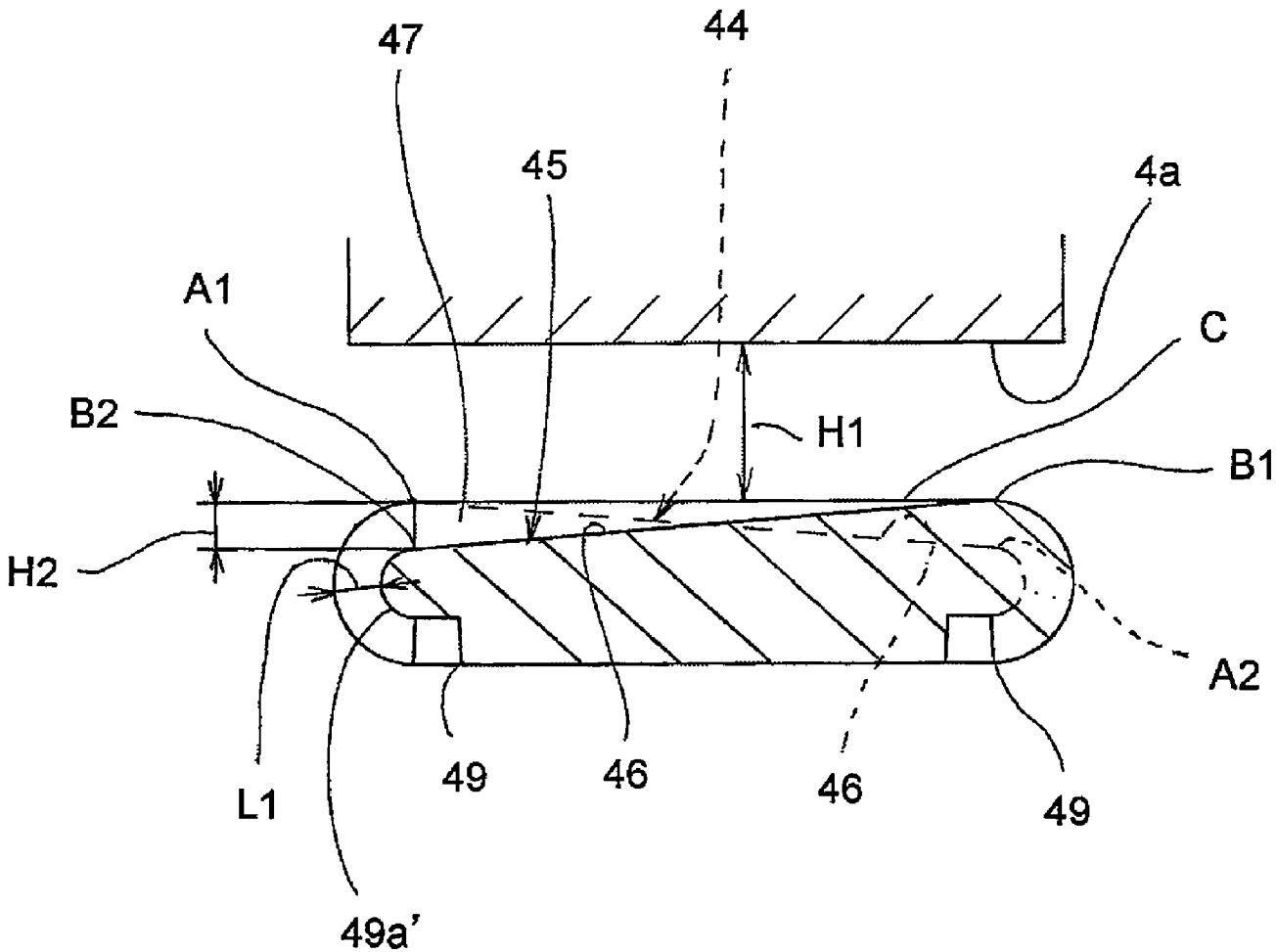
FIG. 9 is sectional view of an ink receiving portion according to another embodiment of the present invention.
Figure 10:
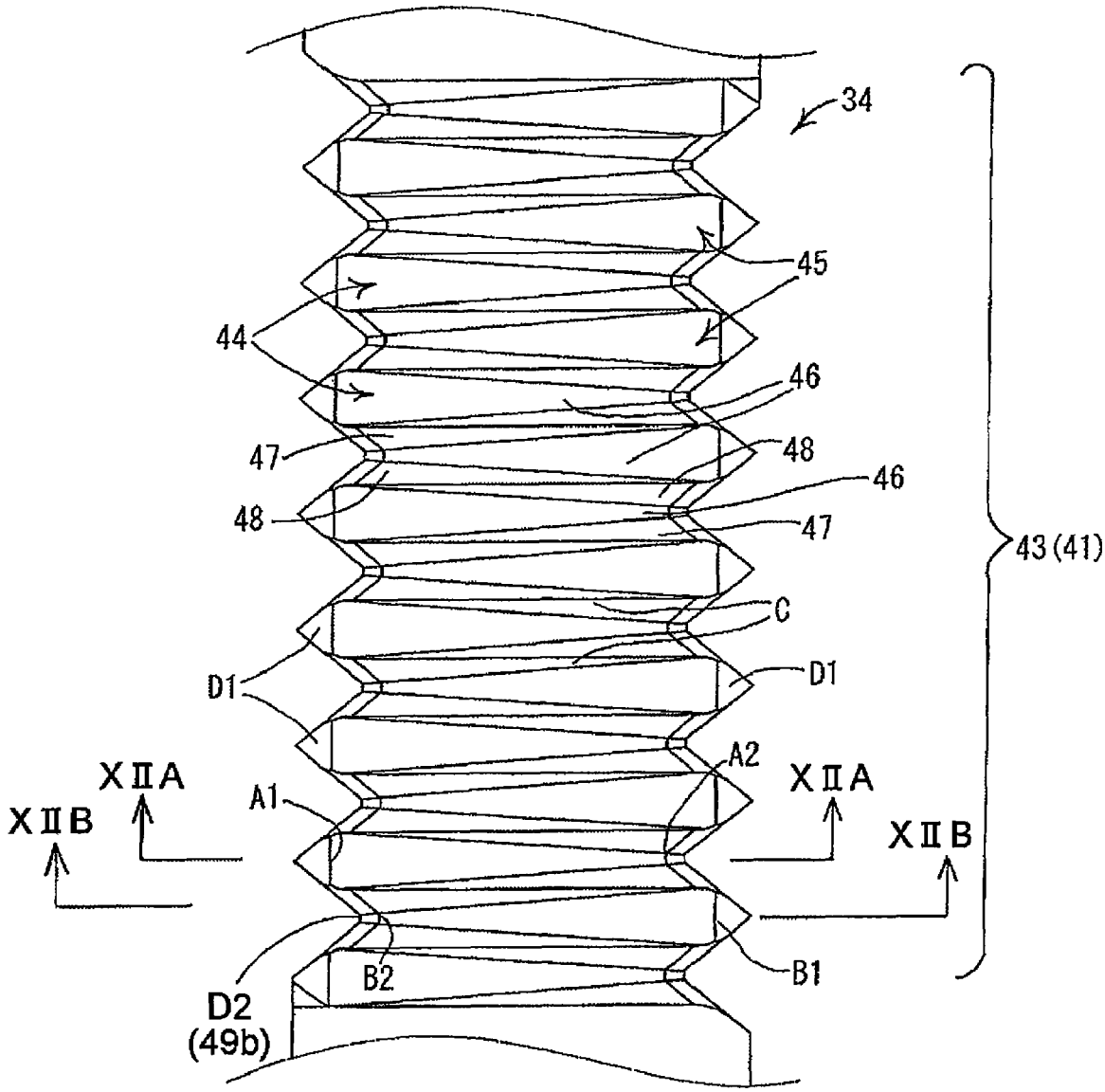
FIG. 10 is a partial, plan view of an ink receiving portion according to another embodiment of the present invention.
Figure 11:
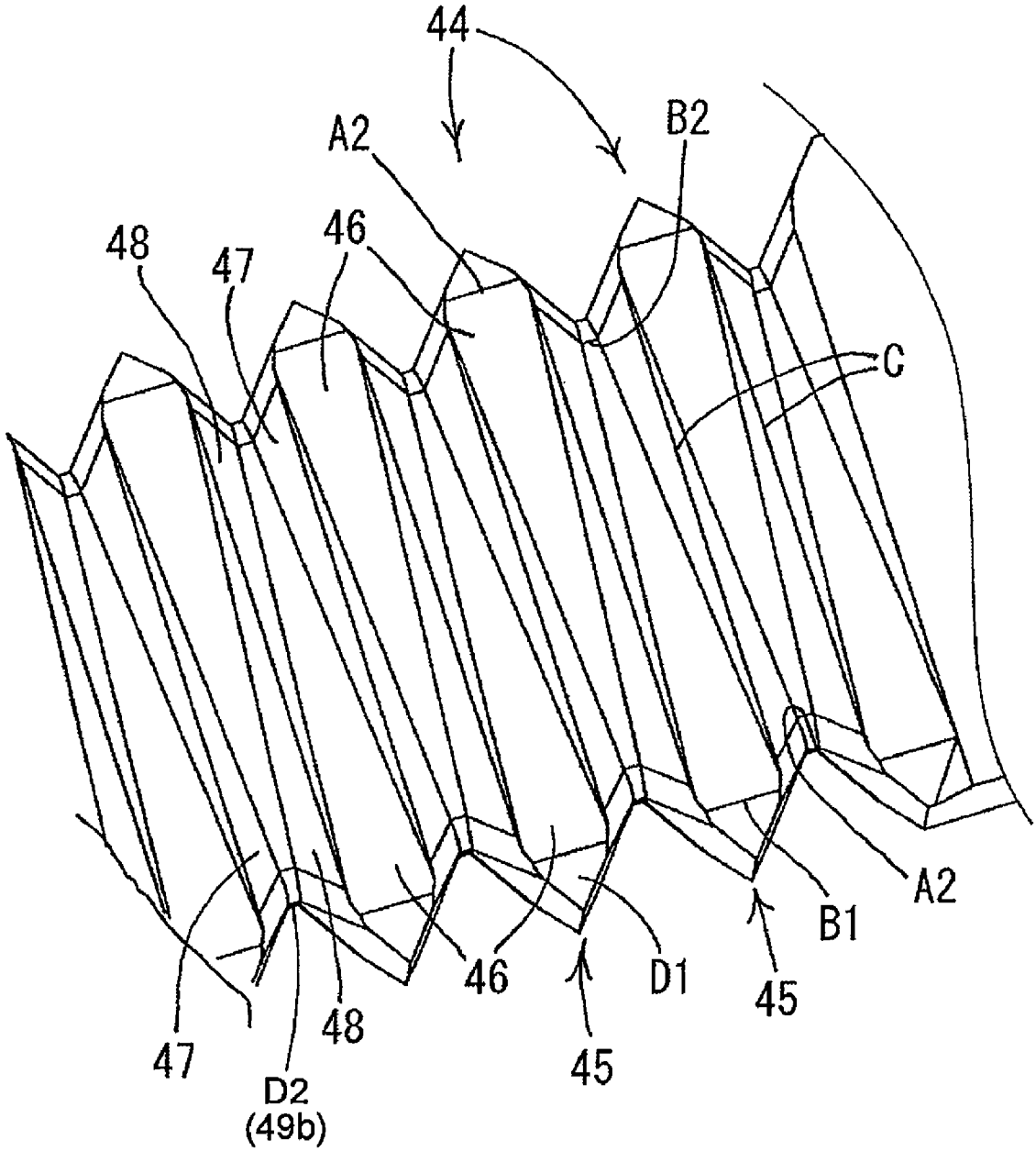
FIG. 11 is a perspective view of first guides and second guides of the ink receiving portion of FIG. 10.
Figure 12A:
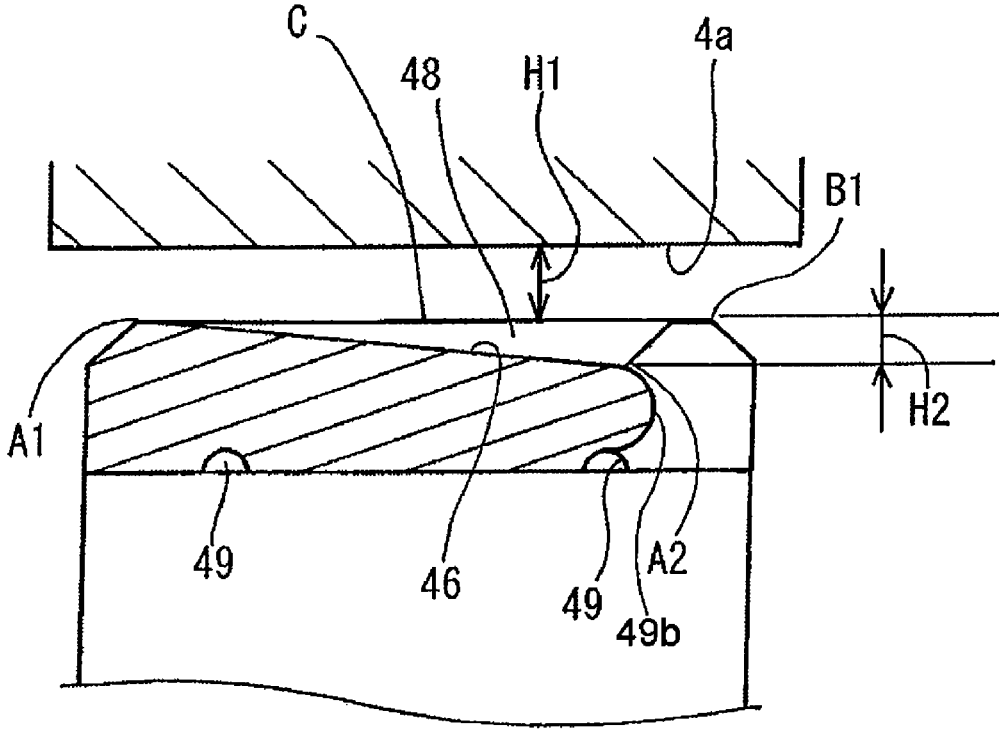
FIG. 12A is a sectional view of the ink receiving portion of FIG. 10, as viewed along line XIIA-XIIA.
Figure 12B:
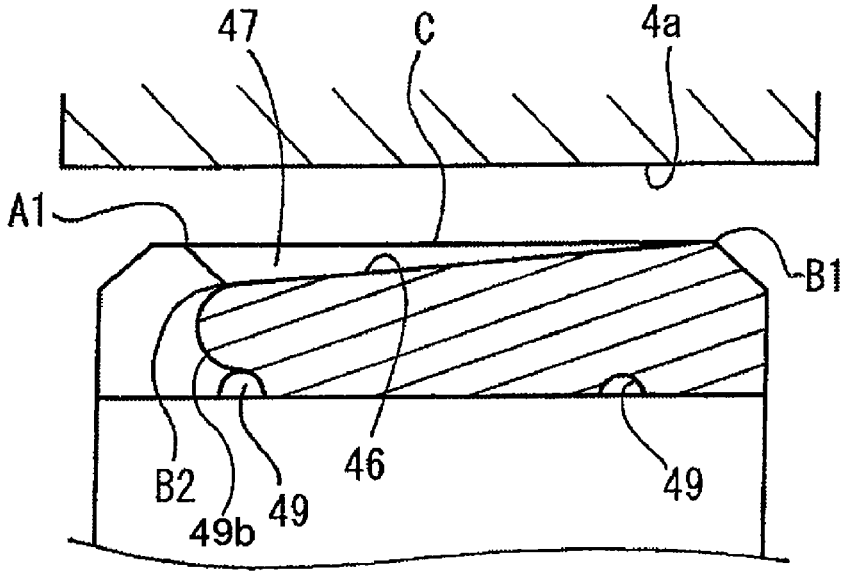
FIG. 12B is a sectional view of the ink receiving portion of FIG. 10, as viewed along line XIIB-XIIB.
Figure 13A:
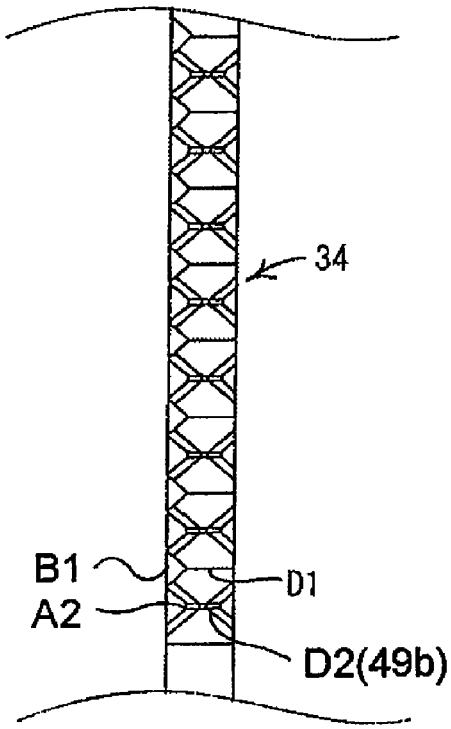
FIG. 13A is a partial, side view of the ink receiving portion of FIG. 10.
Figure 13B:
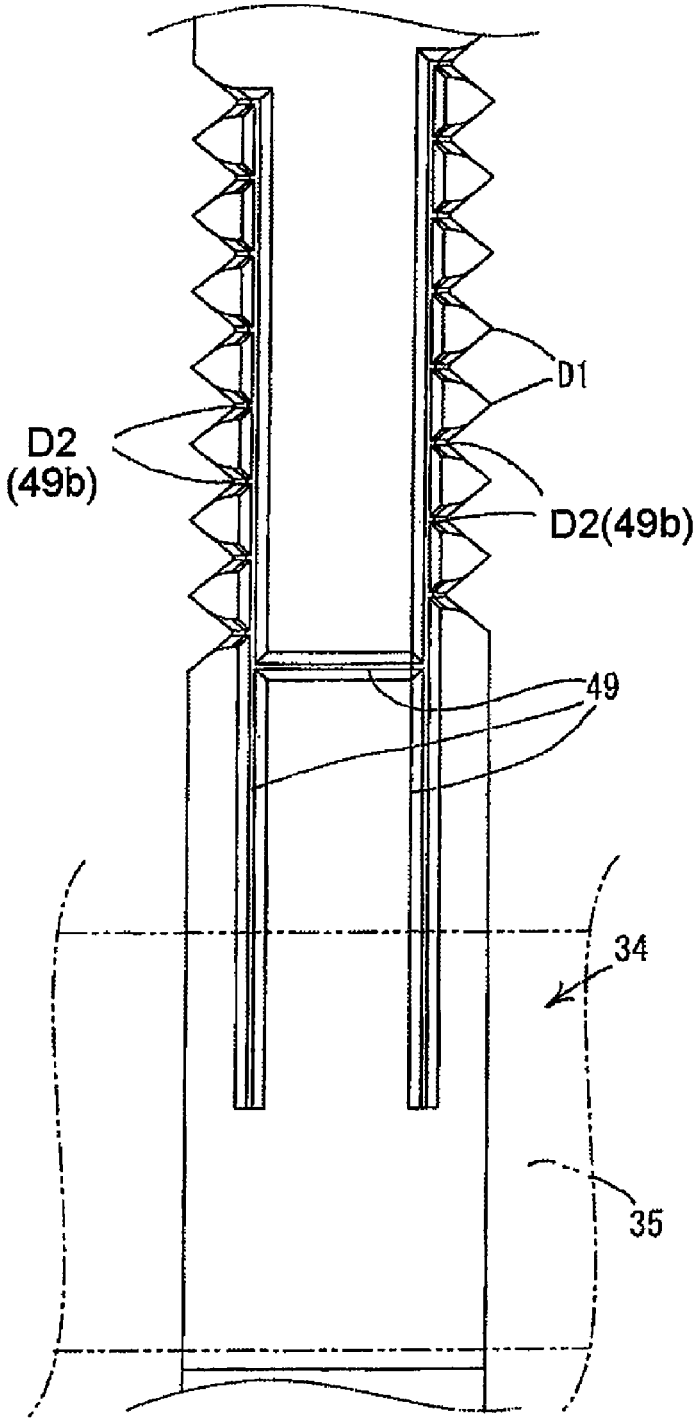
FIG. 13B is a partial, bottom view of the ink receiving portion of FIG. 10.

FIG. 9 depicts another embodiment of the present invention. This embodiment is substantially similar to the above-described embodiments of the present invention, except for a through groove 49*a*'. Although the depth of the through groove 49*a* depicted in FIG. 8B is not constant and varies between the low portion A1 (low portion B2) and the drain groove 49, the through groove 49*a* may be configured differently. As shown in FIG. 9, the through groove 49*a*' has a width which is less than or equal to the width of the low portion A2 (low portion B2), and has a depth L1 which is substantially equal to the depth of the first guide 44 (second guide 45) at the low portion A2 (low portion B2), which is the distance H2. The depth of the through groove 49*a*' is constant between the low portion A1 (low portion B2) and the drain groove 49. Alternatively, the depth of the through groove 49*a*' may be less than the depth of the first guide 44 (second guide 45) at the low portion A2 (low portion B2). Thus, the capillarity for the ink is maintained or increases from the low portion A2 (low portion B2) to the through groove 49*a*'.

FIGS. 10-13 depicts another embodiment of the present invention. This embodiment is substantially similar to the above-described embodiments of the present invention depicted in FIGS. 1-8, except for a shape of an end portion D1 of a first guide 44 (second guide 45) adjacent to a high portion A1 (high portion B1), and a shape of an end portion D2 of the first guide 44 (second guide 45) adjacent to a low portion A2 (low portion B2). The end portion D1 may be triangular in the plan view. A through groove 49*b* may be formed at the end portion D2 to communicate with the low portion A2 (low portion B2) and drain grooves 49. The width of the through groove 49*b* is less than or equal to the width of the low portion A2 (low portion B2), and the depth of the through groove 49*b* is greater than the depth of the first guide 44 (second guide 45) at the low portion A2 (low portion B2), which is the distance H2. This embodiment achieves the similar effects to those achieved in the above-described embodiments.

Figure 14A:
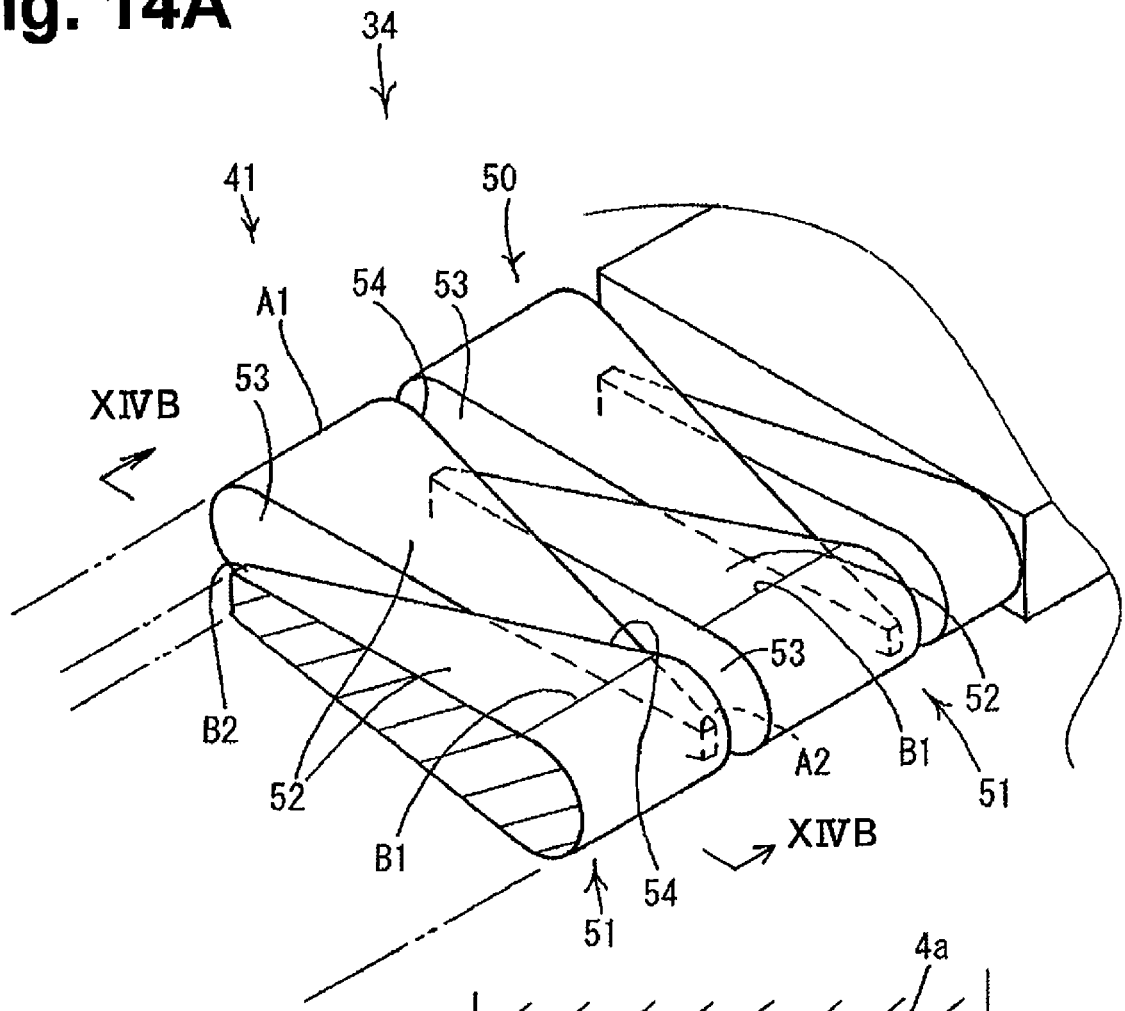
FIG. 14A is a perspective view of first guides and second guides of an ink receiving portion, according to another embodiment of the present invention.
Figure 14B:
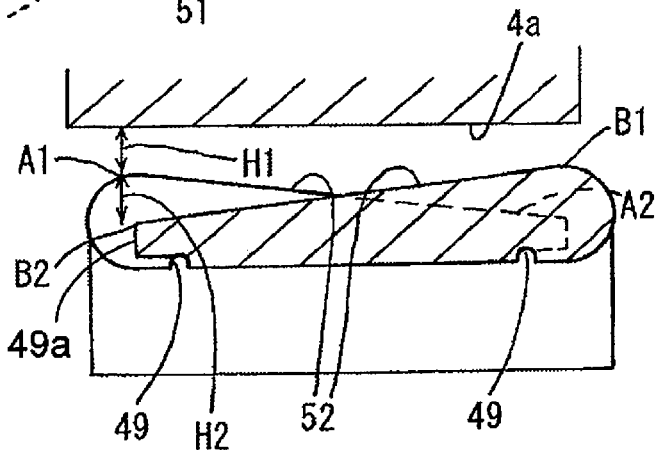
FIG. 14B is a sectional view of the ink receiving portion of FIG. 14A, as viewed along line XIVB-XIVB.

FIGS. 14A and 14B show an ink receiving portion 41 according to yet another embodiment of the present invention. In this embodiment, each of the first guides 50 and each of the second guides 51 of the ink receiving portion 41 has a high portion A1 (B1) a low portion A2 (B2). The high portion A1 (B1) may be separated from the nozzle face 4*a* by a distance H1, and the low portion A2 (B2) may be separated from the nozzle face 4*a* by a distance H1+H2. The first guide 50 may comprise a slanting bottom face 52 and two opposed triangular side faces 53 and 54 extending upright from the bottom face 52 toward the nozzle face 4*a*. The bottom face 52 has the high portion A1 and the low portion A2, and is slanted, such that the depth of the first guide 44 increases gradually from the high portion A1 toward the low portion A2. Similarly, the second guide 52 comprises a slanting bottom face 52 and two opposed triangular upright side faces 53 and 54 extending from the bottom face 52. The bottom face 52 has the high portion B1 and the low portion B2, and is slanted, such that the depth of the second guide 51 increases gradually from the high portion B1 toward the low portion B2. The bottom face 51 functions as a guide face for guiding the ink to the low portion A2 (B2), and the side faces 53 and 54 function as partition faces for partitioning the first guide 50 from the second guide 51.

The bottom face 52 of the first guide 50 has a width that decreases gradually from the high portion A1 toward the low portion A2. The width of the bottom face 52 is perpendicular to the ink flowing direction which is along the X-axis direction. Similarly, the bottom face 52 of the second guide 51 has a width that decreases gradually from the high portion B1 toward the low portion B2.

The first guide 50 and the second guide 51 may have an identical size and shape, and the number of first guides 50 may be equal to the number of second guides 51 in the ink receiving portion 41.

Ink reaching the first guide 50 and the second guide 51 of the ink receiving portion 41 flows from high to low by gravity. The ink flowing directions in the first and second guides 50 and 51 are opposite to each other. The ink flows from the high portion A1 toward the low portion A2 in the first guide 50, while the ink flows from the high portion B1 toward the low portion B2 in the second guide 51. The first guides 50 and the second guides 51 may arranged alternatively, such that each first guide 50 may be sandwiched between two second guides 51. The ink flows in the first guides 50 and the second guides 51 along the X-axis direction, which is perpendicular to the sheet conveying direction.

The high portion A1 of the first guide 50 and the high portion B1 of the second guide 51 may be separated from the nozzle face 4*a* by a shorter distance and may have a greater width, which is perpendicular to the ink flowing direction, as compared with the low portion A2 of the first guide 50 and the low portion B2 of the second guide 51, respectively. This improves the likelihood that ejected ink reaches the first and second guides 44 and 45 and reduces generation of ink mist. Thus, ink mist is unlikely to adhere to the cover 34, and the recording medium P is unlikely to be stained with the ink mist.

The width of the low portion A2 (low portion B2) is less than that of the high portion A1 (high portion B1). The width of the bottom face 52 decreases gradually from the high portion A1 (high portion B1) toward the low portion A2 (low portion B2). Thus, the capillarity for the ink and the ability to drain the ink increases gradually in such direction. Ink reaching the first guide 50 (second guide 51) may be guided from the high portion A1 (high portion B1) toward the low portion A2 (low portion B2).

In addition, the bottom face 52 of the first guide 44 (second guide 45) is slanted downward from the high portion A1 (high portion B1) toward the low portion A2 (low portion B2). Thus, ink accumulated in the first guide 50 and the second guide 51 flows smoothly. This enhances the drain of the ink from the surface of the platen 26. The ink is unlikely to overflow the platen 26, and the recording medium that passes over the platen 26 is unlikely to be stained with the ink.

By the alternative arrangement of each first guide 50 and each second guide 51, each high portion A1 (high portions B1), which has a greater width and a shorter distance to the nozzle face 4*a*, and each low portion A2 (low portion B2), which has a shorter width and a greater distance to the nozzle face 4*a*, are alternatively arranged. In this case, the distribution of the high portions A1 and B1 and the low portions A2 and B2 are uniform over the ink receiving portion 41. The distances from the nozzle face 4*a* to different positions of the ink receiving portion 41 are averaged over the ink-receiving portion 41 to a distance that will not cause generation of ink mist. Thus, when ink is ejected beyond edges of the sheet during marginless printing, the likelihood that ink ejected from the nozzles reaches the ink receiving portion 41 increases, and generation of ink mist is reduced.

In addition to the alternate arrangement of each first guides 50 and each second guide 51, if the first guide 50 and the second guide 51 have an identical size and shape, and the number of first guides 50 are equal to the number of second guides 51 in the ink receiving portion 41, the above-described effects may be enhanced.

Through grooves 49*a* may be each formed at an end portion of the first guide 50 (second guide 51) adjacent to the low portion A2 (low portion B2) similarly to the through groves 49*a* of the above-described embodiments. Drain grooves 49 may be formed in a lower surface of the cover 34 similarly to the drain grooves 49 of the embodiment shown in FIG. 6. The through grooves 49*a* and the drain grooves 49 achieve the similar effects to those achieved in the above-described embodiments.

Although, in the above-described embodiments, each first guide 44 (50) and each second guide 45 (51) are arranged alternatively, two or more first guides and two or more second guides may be arranged alternatively. In this case, a groove, which may be rectangular in the plan view and having a uniform height, may be formed between the two or more first guides and the two or more second guides.

Although, in the above-described embodiments, the first guides 44 (50) and the second guides 45 (51) are arranged, such that the ink flowing directions therein are parallel to the X-axis direction, which is perpendicular to the sheet conveying direction, first guides and the second guides may be arranged, such that the ink flowing directions therein are parallel to the sheet conveying direction (Y-axis direction). In this case, grooves may be formed through the ink receiving portion 41 at the low portions of the first and second guides because the low portions have no end faces defined by the slits 42.

A plurality of first guides and a plurality of second guides may be arranged, such that each first guide is adjacent to a corresponding second guide. In this case, when the ink flowing direction in one of the first guides and the ink flowing direction in one of the second guides are parallel to the X-axis direction, the ink flowing directions in the rest of the first guides and the rest of the second guides may be slightly inclined with respect to the X-axis direction. Alternatively, when the ink flowing direction in one of the first guides and the ink flowing direction in one of the second guides are parallel to the Y-axis direction, the ink flowing directions in the rest of the first guides and the rest of the second guides may be slightly inclined with respect to the Y-axis direction.

Although, in the above-described embodiments, the platen 42 comprises the movable ribs 37 configured to reciprocate along the slits 42, the platen may not include movable ribs or slits.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the following claims.

What is claimed is:

1. An image forming device comprising:

a recording head comprising a nozzle face, wherein the recording head is configured to dispense ink onto a recording medium to form an image thereon;

a supporting member which faces the nozzle face and is configured to support the recording medium; and an ink receiving portion which is positioned on the supporting member and faces the nozzle face, wherein the ink receiving portion comprises:

a first plurality guides; and a second plurality of guides, wherein each of the first plurality of guides and each of the second plurality of guides comprises a guide face and is configured to guide the ink dispensed from the recording head, wherein the guide face comprises a first portion and a second portion, wherein a first distance between the nozzle face and the first portion of the guide face of each of the first plurality of guides is less than a second distance between the nozzle face and the second portion of the guide face of each of the first plurality of guides, and the first distance is less than a third distance between the nozzle face and the second portion of the guide face of each of the second plurality of guides, wherein a fourth distance between the nozzle face and the first portion of the guide face of each of the second plurality of guides is less than the third distance between the nozzle face and the second portion of the guide face of each of the second plurality of guides, and the fourth distance is less than the second distance between the nozzle face and the second portion of the guide face of each of the first plurality of guides, and wherein each of the first plurality of guides is configured to guide the ink dispensed from the recording head in a first ink flowing direction, and each of the second plurality of guides is configured to guide the ink dispensed from the recording head in a second ink flowing direction opposite the first ink flowing direction.

2. The image forming device of claim 1, wherein the nozzle face has a plurality of nozzles formed therethrough, and the recording head is configured to dispense the ink onto the recording medium via the plurality of nozzles.

3. The image forming device of claim 1, wherein the guide face is slanted with respect to the nozzle face, and a guide distance between the nozzle face and the guide face of each of the first plurality of guides and each of the second plurality of guides increases from the first portion of the guide face toward the second portion of the guide face.

4. The image forming device of claim 3, wherein the guide distance between the nozzle face and the guide face increases from the first portion of the guide face toward the second portion of the guide face at a substantially constant rate.

5. The image forming device of claim 3, wherein the nozzle face has a plurality of nozzles formed therethrough, and the recording head is configured to dispense the ink onto the recording medium via the plurality of nozzles.

6. The image forming device of claim 3, wherein the guide face of each of the first plurality of guides and each of the second plurality of guides has a width which decreases from the first portion toward the second portion, and the width is perpendicular to each of the first ink flowing direction and the second ink flowing direction.

7. The image forming device of claim 1, wherein at least one of the first plurality of guides are arranged alternatively with respect to at least one of the second plurality of guides.

8. The image forming device of claim 1, wherein a number of the first plurality of guides is equal to a number of the second plurality of guides.

9. The image forming device of claim 1, wherein a size and a shape of each of the first plurality of guides is the same as a size and a shape of each of the second plurality of guides.

10. The image forming device of claim 1, wherein each of the first plurality of guides and each of the second plurality of guides comprises a pair of opposing triangular faces which extend from the guide face toward the nozzle face, and the pair of opposing triangular faces are slanted with respect to the nozzle face.

11. The image forming device of claim 1, wherein each of the first plurality of guides and each of the second plurality of guides comprises a pair of opposing triangular faces which extend from the guide face toward the nozzle face, and the pair of opposing triangular faces are perpendicular to the nozzle face.

12. The image forming device of claim 1, wherein each of the first ink flow direction and the second ink flow direction is parallel to a particular direction which is perpendicular to a conveying direction of the recording medium.

13. The image forming device of claim 1, wherein the supporting member comprises a drain passage into which the ink is drained from the second portion of the guide face of each of the first plurality of guides and each of the second plurality of guides.

14. The image forming device of claim 13, further comprising a waste ink collector, wherein the drain passage is connected to the waste ink collector.

15. The image forming device of claim 14, wherein the ink receiving portion is positioned on a first side of the supporting member, and the waste ink collector is positioned on at least one of the first side of the supporting member and a second side of the supporting member opposite to the first side.

16. The image forming device of claim 13, wherein the ink receiving portion is positioned on a first side of the supporting member, and the drain passage comprises a through groove which penetrates the supporting member and through which the ink is drained from the second portion to a second side of the supporting member opposite to the first side.

17. The image forming device of claim 16, wherein a width of the through groove is less than or equal to a width of the second portion, and a depth of the through groove is less than or equal to a distance between the first portion and the second portion in a direction perpendicular to the nozzle face.

18. The image forming device of claim 1, wherein each of the first plurality of guides is arranged alternatively with each of the second plurality of guides, and each of the first plurality of guides and each of the second plurality of guides comprises partition faces which extend from the guide face toward the nozzle face and partition adjacent ones of the first plurality of guides and the second plurality of guides.

19. The image forming device of claim 1, wherein the ink receiving portion comprises a plurality of the ink receiving portions that are arranged on the supporting member in a direction perpendicular to a conveying direction of the recording medium.

20. The image forming device of claim 19, wherein the supporting member comprises:

a plurality of slits, wherein each of the plurality of slits is positioned between two adjacent ink receiving portions; and a plurality of movable ribs configured to move into a corresponding one of the plurality of slits along the conveying direction of the recording medium.

21. The image forming device of claim 1, wherein the supporting member comprises a first drain passage into which the ink is drained from the second portion of the guide face of each of the first plurality of guides, and a second drain passage into which the ink is drained from the second portion of the guide face of each of the second plurality of guides, and wherein the first drain passage and the second drain passage are perpendicular to the first ink flowing direction and the second ink flowing direction.

* * * * *